US009927184B2

(12) United States Patent
Fujita et al.

(10) Patent No.: US 9,927,184 B2
(45) Date of Patent: Mar. 27, 2018

(54) HEAT EXCHANGER

(71) Applicant: Sumitomo Precision Products Co., Ltd., Amagasaki-shi, Hyogo (JP)

(72) Inventors: Yasuhiro Fujita, Amagasaki (JP); Hiroyuki Takahashi, Amagasaki (JP); Akihiro Tanabe, Amagasaki (JP)

(73) Assignee: Sumitomo Precision Products Co., Ltd., Amagasaki-shi (JP)

( * ) Notice: Subject to any disclaimer, the term of this patent is extended or adjusted under 35 U.S.C. 154(b) by 32 days.

(21) Appl. No.: 15/127,050

(22) PCT Filed: Mar. 16, 2015

(86) PCT No.: PCT/JP2015/057732

§ 371 (c)(1),
(2) Date: Sep. 19, 2016

(87) PCT Pub. No.: WO2015/141634

PCT Pub. Date: Sep. 24, 2015

(65) Prior Publication Data

US 2017/0108284 A1 Apr. 20, 2017

(30) Foreign Application Priority Data

Mar. 20, 2014 (JP) ..... 2014-057390

(51) Int. Cl.

| | |
|---|---|
| ***F28F 3/00*** | (2006.01) |
| ***F28D 9/00*** | (2006.01) |
| ***F28F 3/02*** | (2006.01) |

(52) U.S. Cl.

CPC ..... *F28D 9/0062* (2013.01); *F28F 3/025* (2013.01); *F28F 2240/00* (2013.01); *F28F 2265/16* (2013.01); *F28F 2275/06* (2013.01)

(58) Field of Classification Search

CPC . F28D 9/0062; F28D 7/00; F28D 9/00; F28D 1/0308; F28D 9/0006;

(Continued)

(56) References Cited

U.S. PATENT DOCUMENTS 4,848,450 A * 7/1989 Lapkowsky ..... F28D 9/0037 165/164
5,617,913 A * 4/1997 DeGregoria ..... A61M 16/1045 128/201.13

(Continued)

FOREIGN PATENT DOCUMENTS

DE 10 2008 053 462 A1 5/2010
EP 0 038 454 A2 10/1981

(Continued)

OTHER PUBLICATIONS

International Search Report (PCT/ISA/210) issued in PCT Application No. PCT/JP2015/057732 dated May 19, 2015 with English translation (five pages).

(Continued)

*Primary Examiner* — Justin Jonaitis
(74) *Attorney, Agent, or Firm* — Crowell & Moring LLP

(57) ABSTRACT

A spacer portion (3) of this heat exchanger (100) includes an outer peripheral portion (3*a*) circumferentially provided along outer peripheral edges of bonded surfaces (1*a*) of cores (1) and a gap portion (3*b* and 3*c*) provided in a partial region of the circumferential outer peripheral portion, and the gap portion is provided at a position where a temperature gradient on the bonded surfaces of the cores is relatively shallow.

8 Claims, 7 Drawing Sheets

(58) Field of Classification Search
CPC .... F28D 9/0025; F28D 9/0031; F28D 9/0037; F28D 7/16; F28D 9/0081; F28D 7/0066; F28D 7/022; F28D 9/0093; F28D 1/00; F28D 1/05308; F28D 1/05316; F28D 1/05358; F28D 1/05366; F28F 3/025; F28F 2240/00; F28F 2265/16; F28F 2275/06; F28F 3/005; F28F 3/08; F28F 3/02; F28F 3/083; F28F 1/00; F28F 9/02; F28F 2009/0285; F28F 9/0246; F28F 9/04
USPC ..... 165/166, 164, 165, 140, 172, 173, 175, 165/176
See application file for complete search history.

(56) References Cited

U.S. PATENT DOCUMENTS

2008/0245398 A1* 10/2008 Bell ..... F02G 1/043 136/224
2009/0032232 A1* 2/2009 Murayama ..... F28D 9/0037 165/167
2010/0097751 A1* 4/2010 Doll ..... G06F 1/20 361/679.47
2012/0324909 A1* 12/2012 Brehm ..... F01N 3/043 62/3.2
2014/0150656 A1* 6/2014 Vandermeulen ..... F28F 1/02 96/7
2014/0231055 A1* 8/2014 Schalansky ..... F28F 3/086 165/166
2017/0162884 A1* 6/2017 Shimada ..... H01M 8/04014

FOREIGN PATENT DOCUMENTS

JP 2012-255646 A 12/2012
WO WO 2009/013179 A2 1/2009

OTHER PUBLICATIONS

Japanese-language Written Opinion (PCT/ISA/237) issued in PCT Application No. PCT/JP2015/057732 dated May 19, 2015 (three pages).

* cited by examiner (FIRST EMBODIMENT)

(SECOND EMBODIMENT)

FIG. 14 (COMPARATIVE EXAMPLE)

HEAT EXCHANGER

TECHNICAL FIELD

The present invention relates to a heat exchanger, and more particularly, it relates to a heat exchanger including multiple cores and spacer portions arranged between bonded surfaces of the adjacent cores.

BACKGROUND ART

A heat exchanger including multiple cores and spacer portions arranged between bonded surfaces of the adjacent cores is known in general. A heat exchanger like this is disclosed in Japanese Patent Laying-Open No. 2012-255646, for example.

In Japanese Patent Laying-Open No. 2012-255646, there is disclosed a heat exchanger including multiple cores, spacer portions arranged between bonded surfaces of the adjacent cores, and a header portion. In the cores, two types of flow path portions through which two types of fluids flow, respectively, are alternately stacked. The cores each have a rectangular parallelepiped shape, the spacer portions each are formed in an L-shape along two sides of each of the outer peripheral edges of the bonded surfaces of the cores, and the outer peripheral portions thereof are welded to the bonded surfaces of the adjacent cores.

PRIOR ART

Patent Document

Patent Document 1: Japanese Patent Laying-Open No. 2012-255646

SUMMARY OF THE INVENTION

Problem to be Solved by the Invention

In Japanese Patent Laying-Open No. 2012-255646, when the heat exchanger is used under operational conditions where a temperature difference between a high-temperature side and a low-temperature side is large, deformation is generated in each core so that a large stress is generated in the spacer portions arranged between the cores. In this case, the strength of ends (starting points or end points of welding) of the weld sites located on both sides of each of the L-shaped spacer portions is low, and a stress is concentrated in the ends to be easily increased. Therefore, as the spacer portions, spacer portions capable of sufficiently withstanding a stress under the operational conditions where a temperature difference between a high-temperature side and a low-temperature side is large are preferable.

The header portion is configured to guide the fluids into or out of the flow path portions of each core in one batch by straddling the spacer portions and covering ports of the flow path portions of the multiple cores. Thus, the spacer portions also function as partition walls between the bonded surfaces of the cores to maintain the internal space of the header portion at a predetermined stress. Therefore, when there is poor weld in the weld sites between the spacer portions and the cores, the fluids may be leaked to clearance gaps between the cores. Thus, when the heat exchanger is manufactured, the leakage of the fluids from the header portion to the clearance gaps between the cores is tested. Therefore, the spacer portions each preferably have a shape enabling easy detection of the leakage of the fluids from the header portion to between the cores in the leakage testing.

The present invention has been proposed in order to solve the aforementioned problem, and one object of the present invention is to provide a heat exchanger including spacer portions that enable easy detection of leakage of fluids from a header portion to between cores and are capable of sufficiently withstanding a stress under operational conditions where a temperature difference between a high-temperature side and a low-temperature side is large.

Means for Solving the Problem

In order to attain the aforementioned object, a heat exchanger according to an aspect of the present invention includes multiple cores in which flow path portions through which multiple types of fluids flow are alternately stacked, and a spacer portion arranged between bonded surfaces of the cores adjacent to each other and integrally fixed to the cores on both sides by welding, the spacer portion includes an outer peripheral portion circumferentially provided along outer peripheral edges of the bonded surfaces of the cores and a gap portion provided in a partial region of the circumferential outer peripheral portion, and the gap portion is provided at a position where a temperature gradient on the bonded surfaces of the cores is relatively shallow.

In the heat exchanger according to this aspect of the present invention, as hereinabove described, the outer peripheral portion circumferentially provided along the outer peripheral edges of the bonded surfaces of the cores and the gap portion provided in the partial region of the circumferential outer peripheral portion are provided in the spacer portion, whereby a weld site between the spacer portion and the cores (i.e. the outer peripheral portion of the spacer portion) can be circumferentially formed along the outer peripheral edges of the bonded surfaces while the gap portion is ensured. Consequently, leakage of the fluids can be easily detected through the gap portion, and the circumferential weld site enables an increase in a bond area between the spacer portion and the cores so that the bonding strength can be improved. Furthermore, the gap portion is provided at the position where the temperature gradient on the bonded surfaces of the cores is relatively shallow, considering that an end (a starting point or an end point of welding) of the weld site in which a stress is likely to be concentrated is located in the gap portion, whereby the end of the weld site can also be arranged at the position where the temperature gradient is relatively shallow. Thus, the end of the weld site can be arranged in a region of the bonded surfaces in which a stress caused by deformation following a temperature change is relatively small, and hence an increase in stress can be suppressed even if a stress is concentrated in the end of the weld site. Thus, the bonding strength between the spacer portion and the cores can be improved while an increase in stress in the end (the gap portion) of the weld site can be suppressed, and hence the spacer portion can sufficiently withstand a stress under operational conditions where a temperature difference between a high-temperature side and a low-temperature side is large.

Preferably in the aforementioned heat exchanger according to this aspect, the spacer portion includes a first spacer having a rectangular plate shape and provided on the outer peripheral edges of the bonded surfaces of the cores and regions inside the outer peripheral edges of the bonded surfaces. According to this structure, the stiffness of the first spacer itself can be improved as compared with the structure of providing the spacer in only the outer peripheral edges of the bonded surfaces of the cores. Thus, the spacer portion (the first spacer) itself can be rendered robust to an increase in stress caused by the deformation of the bonded surfaces of the cores.

Preferably in this case, the bonded surfaces of the cores each have a rectangular shape, and the outer peripheral portion of the first spacer having the rectangular plate shape is arranged along three sides of the outer peripheral edges of the bonded surfaces of the cores. According to this structure, the large-size first spacer portion having a rectangular plate shape can be provided, and the weld site of the first spacer can be formed in a wide range over the three sides of the outer peripheral edges of the bonded surfaces of the cores. Consequently, the stiffness of the first spacer itself and the bonding strength between the first spacer and the cores can be further improved.

Preferably, the aforementioned structure in which the spacer portion includes the first spacer having the rectangular plate shape further includes a first header portion provided on first side surfaces of the cores orthogonal to the bonded surfaces and a second header portion provided on second side surfaces of the cores orthogonal to the first side surfaces and the bonded surfaces, and on the bonded surfaces, a first side of the first spacer having the rectangular plate shape, which is closer to the first side surfaces, has a length equal to or more than the width of the first header portion, and a second side of the first spacer, which is closer to the second side surfaces, has a length equal to or more than the width of the second header portion, and extends to the gap portion. According to this structure, the first spacer having the rectangular plate shape can function as a partition wall that prevents leakage of the fluids to a gap between the cores in the first header portion and the second header portion. The second side of the first spacer extends to the gap portion, whereby even when there is poor weld leading to leakage, the leaking fluids passing between the first spacer and the bonded surfaces can be sent to the gap portion. Consequently, leakage from the weld site of the first spacer can be checked simply by detecting the fluids in the gap portion at the time of leakage testing, and hence the leakage of the fluids can be easily detected even when the first spacer is increased in size.

Preferably in this case, on the bonded surfaces of the cores, the spacer portion includes a pair of the first spacers provided closer to a pair of the first side surfaces that sandwiches each of the bonded surfaces therebetween, respectively, and a second spacer having a rectangular plate shape, provided between the pair of first spacers, and arranged through the gap portion with respect to each of the pair of first spacers. According to this structure, due to the pair of first spacers and the second spacer between the pair of first spacers, the spacer portion can be provided in a wide range over the substantially entire bonded surfaces of the cores, and hence the stiffness of the entire spacer portion and the bonding strength between the spacer portion and the cores can be improved. Also in this case, leakage of the fluids occurring in each of the pair of first spacers can be detected from the gap portion between each of the first spacers and the second spacer, and hence the leakage of the fluids can be easily detected.

Preferably in the aforementioned structure in which the spacer portion includes the pair of first spacers and the second spacer having the rectangular plate shape and arranged through the gap portion with respect to each of the pair of first spacers, on the bonded surfaces of the cores, the gap portion is provided to pass through a region between the first spacer and the second spacer from one of the second side surfaces to the other of the second side surfaces. According to this structure, the gap portion as a flow path for detecting the leaking fluids is formed in a simple shape, whereby the leaking fluids can be promptly guided to the outside of the gap portion, and the leaking fluids can be easily detected from the sides of the second side surfaces.

Preferably in the aforementioned structure in which the spacer portion includes the first spacer having the rectangular plate shape, on the bonded surfaces of the cores, the gap portion is provided at a position closer to one of a pair of first side surfaces, which is orthogonal to the bonded surfaces and sandwiches each of the bonded surfaces therebetween, than the other of the pair of first side surfaces in a region in which the temperature gradient is relatively shallow in the bonded surfaces of the cores, and the first spacer having the rectangular plate shape extends from an end closer to the other of the first side surfaces to the gap portion closer to the one of the first side surfaces on the bonded surfaces of the cores. According to this structure, the large-size first spacer over a wide range from an end closer to the other of the first side surfaces to the gap portion closer to one of the first side surfaces can be provided, and hence the stiffness of the first spacer can be improved. Also in this case, the leakage from the weld site of the first spacer can be checked simply by detecting the fluids in the gap portion, and hence the leakage of the fluids can be easily detected.

Preferably, the aforementioned heat exchanger according to this aspect further includes a header portion arranged on side surfaces different from the bonded surfaces of the cores and provided to straddle the spacer portion and to cover the flow path portions of the multiple cores, and the gap portion is arranged at a position that is different from a region in which the header portion is arranged and that is closer to the header portion in regions in which the temperature gradient on the bonded surfaces of the cores is relatively shallow. According to this structure, a distance between the header portion and the gap portion can be reduced. Therefore, the fluids leaking from the side of the header portion through the spacer portion can be more easily and reliably detected while the influence of a temperature change on the end (the gap portion) of the weld site is suppressed.

Effect of the Invention

According to the present invention, as hereinabove described, the heat exchanger including the spacer portion that enables easy detection of the leakage of the fluids from the header portion to between the cores and are capable of sufficiently withstanding a stress under the operational conditions where a temperature difference between a high-temperature side and a low-temperature side is large can be provided.

BRIEF DESCRIPTION OF THE DRAWINGS

FIG. 14 A diagram showing a simulation result of a stress distribution for a temperature distribution shown in FIG. 11 on a spacer portion according to the comparative example.

MODES FOR CARRYING OUT THE INVENTION

Embodiments of the present invention are hereinafter described on the basis of the drawings.

First Embodiment

The structure of a heat exchanger 100 according to this embodiment is now described with reference to FIGS. 1 to 7.

Figure 1:
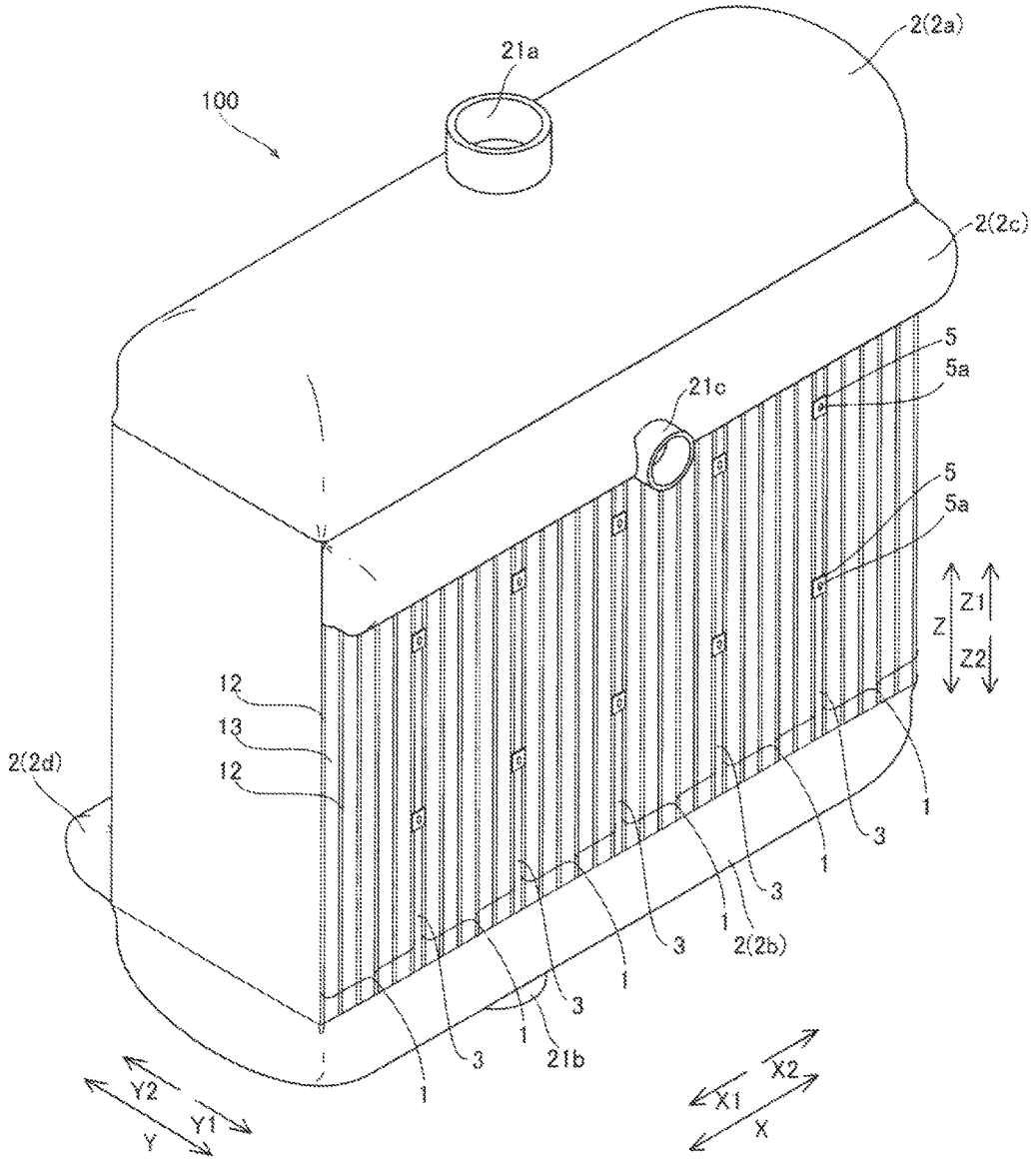
FIG. 1 A perspective view showing the structure of a heat exchanger according to a first embodiment of the present invention.
Figure 2:
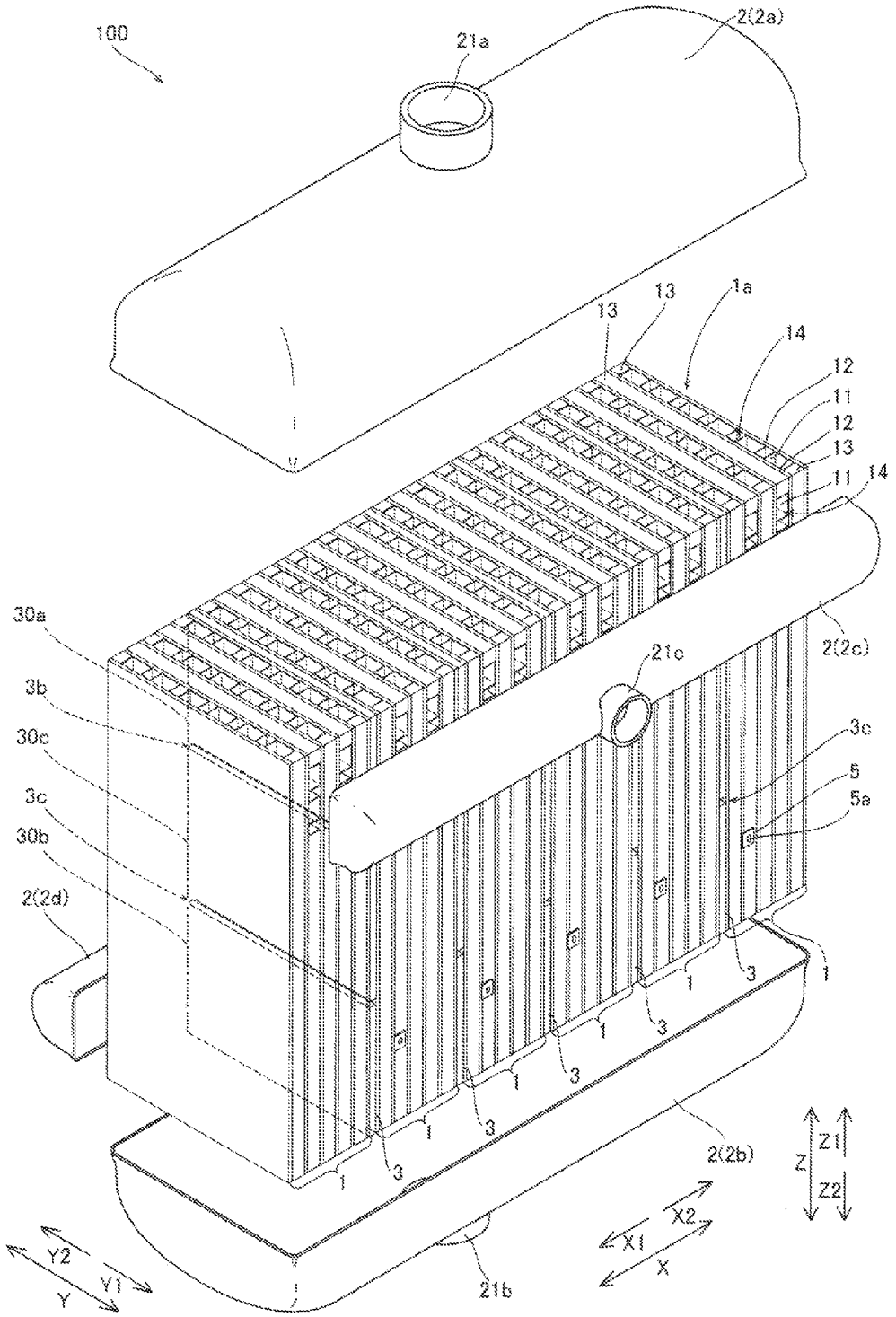
FIG. 2 An exploded perspective view showing the structure of the heat exchanger according to the first embodiment of the present invention.

As shown in FIGS. 1 and 2, the heat exchanger 100 includes multiple cores 1, header portions 2 (header portions 2*a* to 2*d*), and spacer portions 3.

Figure 3:
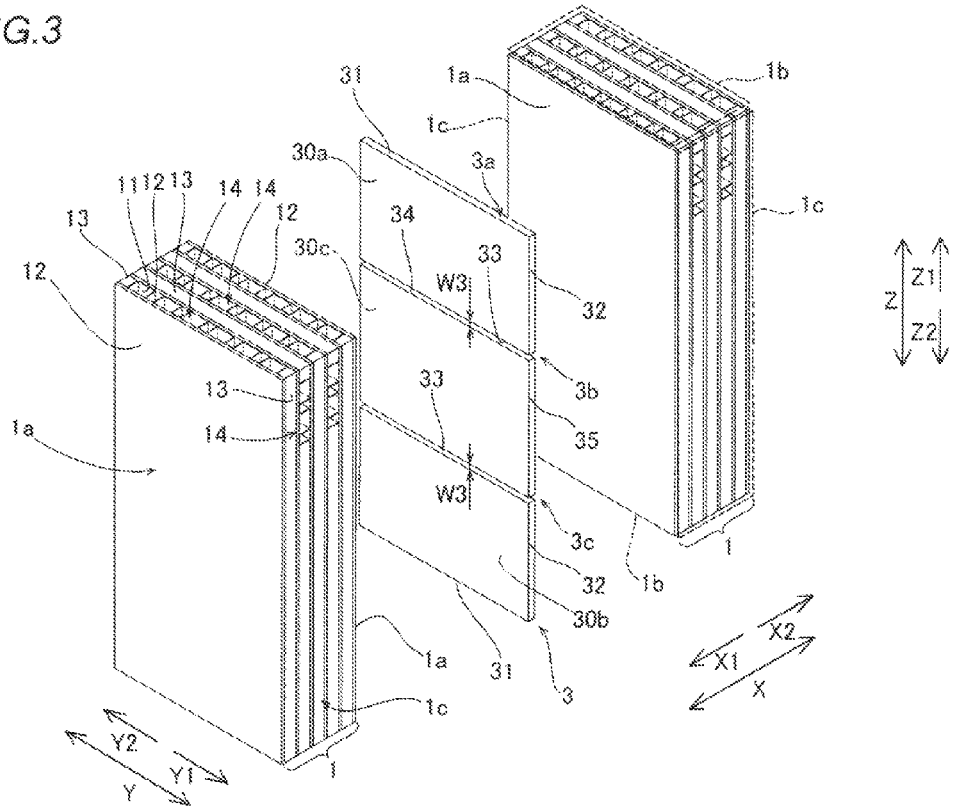
FIG. 3 An exploded perspective view showing cores and a spacer portion of the heat exchanger according to the first embodiment of the present invention.

As shown in FIG. 2, the cores 1 have two types of flow path portions 14 through which a first fluid on a high-temperature side and a second fluid on a low-temperature side flow, respectively, for example, and are configured to exchange heat between the first fluid and the second fluid. In the cores 1, the flow path portions 14 through which multiple types of fluids flow are alternately stacked. The cores 1 include plate-fin type cores 1 in which fins 11 and separate plates 12 (dividers) are alternately stacked, as shown in FIG. 3. In regions surrounded by these fins 11 and separate plates 12, individual paths of the flow path portions 14 are formed. On both side portions of the outer peripheral portions of the fins 11, side bars 13 are arranged, respectively. Each layer partitioned by the separate plates 12 and the side bars 13 constitutes one flow path portion 14. These fins 11, separate plates 12, and side bars 13 are bonded to each other by brazing so that the cores 1 are configured.

As shown in FIG. 3, each of the cores 1 has a rectangular parallelepiped shape. Between the cores 1 adjacent to each other, the spacer portions 3 are arranged. The cores 1 each include bonded surfaces 1*a* that faces the adjacent cores 1, a pair of first side surfaces 1*b* orthogonal to the bonded surfaces 1*a*, and a pair of second side surfaces 1*c* orthogonal to the first side surfaces 1*b* and the bonded surfaces 1*a*. These bonded surfaces 1*a*, first side surfaces 1*b*, and second side surfaces 1*c* each have a rectangular shape. The bonded surfaces 1*a* of the cores 1 adjacent to each other are welded to each other through the spacer portions 3 so that the multiple cores 1 are integrated. For convenience, a direction in which the cores 1 are adjacent to each other is assumed as a direction X, a direction along the long sides of the bonded surfaces 1*a* is assumed as a direction Z, and a direction along the short sides of the bonded surfaces 1*a* is assumed as a direction Y below.

The bonded surfaces 1*a* of the cores 1 are plat surfaces including the outer surfaces of the separate plates 12 located outermost in the cores 1. On the pair of first side surfaces 1*b*, ends of the multiple flow path portions 14 are exposed over the entire first side surfaces 1*b*, respectively. On the pair of second side surfaces 1*c*, ends of the multiple flow path portions 14 are aligned along the direction X and exposed, respectively. On the second side surfaces 1*c* on a Y1 side, the flow path portions 14 are exposed in ends on a Z1 side, and on the second side surfaces 1*c* on a Y2 side, the flow path portions 14 are exposed in ends on a Z2 side.

Figure 4:
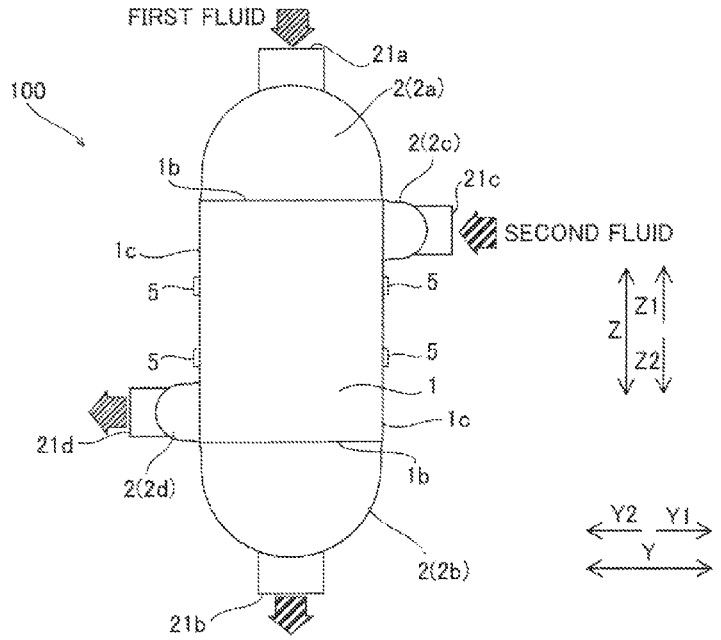
FIG. 4 A side elevational view of the heat exchanger according to the first embodiment of the present invention, as viewed from an X-direction side.

As shown in FIG. 4, a total of four header portions 2 are arranged on the first side surfaces 1*b* (the header portions 2*a* and 2*b*) and the second side surfaces 1*c* (the header portions 2*c* and 2*d*) different from the bonded surfaces 1*a* of the cores 1. These header portions 2 (2*a* to 2*d*) are provided to straddle the spacer portions 3 and cover the flow path portions 14 (see FIG. 2) of the multiple cores 1. Each of the header portions 2 (2*a* to 2*d*) is configured to guide the fluids into or out of each of the flow path portions 14 of the multiple cores 1 in one batch. Each of the header portions 2 (2*a* to 2*d*) is mounted on the first side surfaces 1*b* or the second side surfaces 1*c* by welding. The header portions 2*a* and 2*b* are examples of the "first header portion" in the present invention. The header portions 2*c* and 2*d* are examples of the "second header portion" in the present invention.

The header portion 2*a* is provided on the first side surfaces 1*b* on a first end side (Z1 side) in the longitudinal direction of the cores 1, and the header portion 2*b* is provided on the first side surfaces 1*b* on a second end side (Z2 side) in the longitudinal direction of the cores 1. Over the entire the first side surfaces 1*b*, the flow path portions 14 are provided, and hence these header portions 2*a* and 2*b* are provided to cover the entire first side surfaces 1*b*, respectively. The header portion 2*a* is provided with an inflow/outflow port 21*a* through which the fluids flow in or flow out, and the header portion 2*b* is provided with an inflow/outflow port 21*b* through which the fluids flow in or flow out.

The header portion 2*c* is provided on the second side surfaces 1*c* on a first end side (Y1 side) in the short-side direction of the cores 1, and the header portion 2*d* is provided on the second side surfaces 1*c* on a second end side (Y2 side) in the short-side direction of the cores 1. These header portions 2*c* and 2*d* are provided to cover only portions of the second side surfaces 1*c* on which the flow path portions 14 are exposed, respectively. The header portion 2*c* is provided with an inflow/outflow port 21*c* through which the fluids flow in or flow out, and the header portion 2*d* is provided with an inflow/outflow port 21*d* through which the fluids flow in or flow out.

Figure 5:
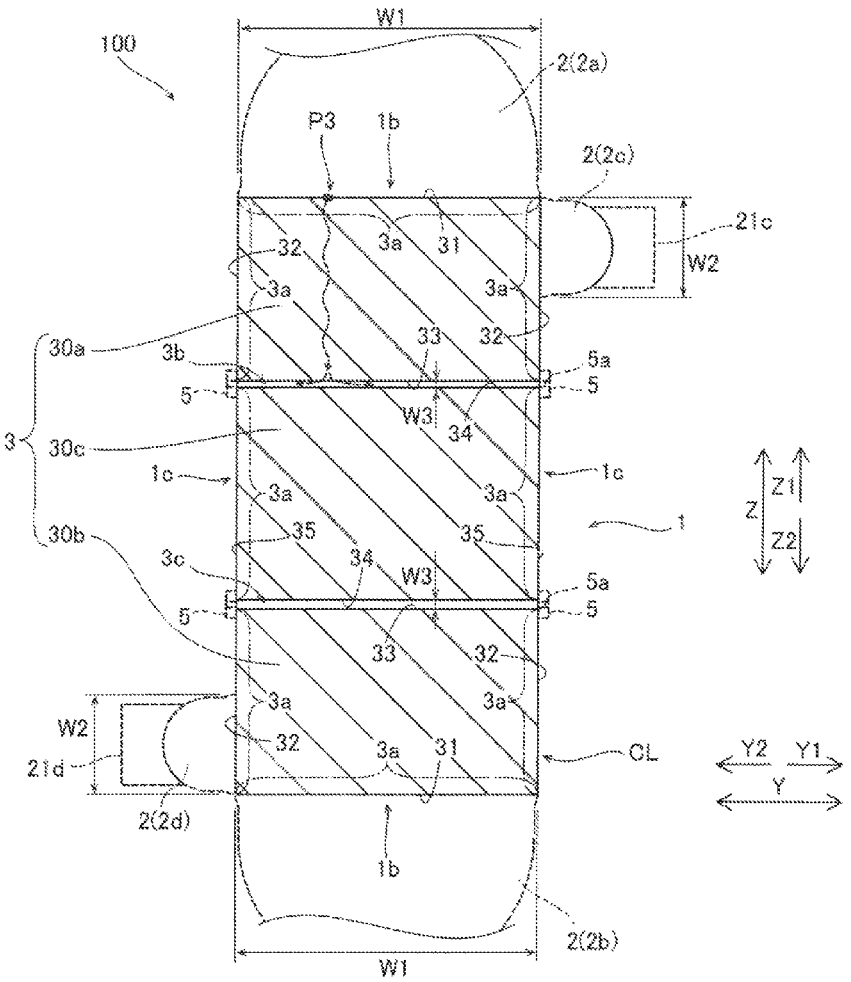
FIG. 5 A diagram of a bonded surface side of a core for illustrating the structure of the spacer portion of the heat exchanger according to the first embodiment of the present invention.

As shown in FIG. 3, the spacer portions 3 are arranged between the bonded surfaces 1*a* of the cores 1 adjacent to each other, and are integrally fixed to the cores 1 on both side by welding. The spacer portions 3 include outer peripheral portions 3*a* circumferentially provided along the outer peripheral edges of the bonded surfaces 1*a* of the cores 1 and gap portions 3*b* and 3*c* provided in partial regions of the circumferential outer peripheral portions 3*a*. According to the first embodiment, the spacer portions 3 each are constituted by three members of two first spacers 30*a* and 30*b* and one second spacer 30*c*. These first spacers 30*a* and 30*b* and second spacer 30*c* each have substantially the same thickness as the thicknesses of the separate plates 12 or a thickness less than the thicknesses of the separate plates 12. For convenience, FIGS. 1 to 3 exaggeratingly show the thicknesses of the first spacers 30*a* and 30*b* and the second spacer 30*c*. As shown in FIG. 5, these first spacers 30*a* and 30*b* and second spacer 30*c* are arranged apart from each other in the longitudinal direction (see FIG. 1) of the bonded surfaces 1*a* (see FIG. 3), and the gap portions 3*b* an 3*c* are constituted by gaps between the first spacers 30*a* and 30*b* and the second spacer 30*c*.

Figure 6:
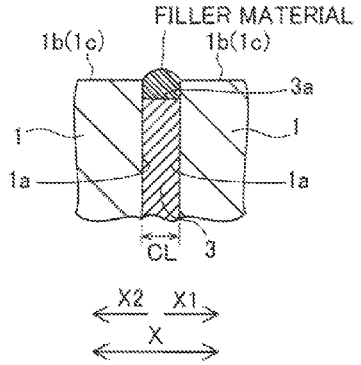
FIG. 6 A schematic partial sectional view for illustrating a weld site between the adjacent core and the spacer portion.

The outer peripheral portions 3*a* of the spacer portions 3 denotes entire portions along the outer peripheral edges of the bonded surfaces 1*a*, of the outer peripheral portions (sides) of the individual first spacers 30*a* and 30*b* and second spacer 30*c*. The spacer portions 3 are welded in a state where the same are held between the bonded surfaces 1*a* of the adjacent cores 1, and hence only the outer peripheral portions 3*a* along the outer peripheral edges of the bonded surfaces 1*a* are welded. Sides arranged inside the bonded surfaces 1*a*, of the sides of the first spacers 30*a* and 30*b* and the second spacer 30*c*, are not welded. In practice, as shown in FIG. 6, the outer peripheral portions 3*a* of the spacer portions 3 are not flush with the outer peripheral edges of the bonded surfaces 1*a* but are arranged at positions deviated slightly inward from the outer peripheral edges. In other words, the outer peripheral portions 3*a* of the spacer portions 3 constitute the bottom surfaces of grooves slightly concaved with respect to the first side surfaces 1*b* and the second side surfaces 1*c* in a state where the spacer portions 3 are held by the bonded surfaces 1*a*, and allow filler materials (welding rods) to enter into the grooves during welding.

As shown in FIG. 5, the first spacers 30*a* and 30*b* each have a rectangular plate shape provided in the outer peripheral edge of a bonded surface 1*a* of a core 1 and a region inside the outer peripheral edge of the bonded surface 1*a*. The outer peripheral portions of the first spacers 30*a* and 30*b* are arranged along three sides of the outer peripheral edge of the bonded surface 1*a* of the core 1. Specifically, the first spacers 30*a* and 30*b* are provided along the outer peripheral edge of the bonded surface 1*a* closer to one of the first side surfaces 1*b* and the respective outer peripheral edges of the bonded surface 1*a* closer to both of the second side surfaces 1*c*.

According to the first embodiment, the header portions 2*a* and 2*b* each cover the entire first side surfaces 1*b*, and hence first sides 31 of the first spacers 30*a* and 30*b* each have a length substantially equal to the width W1 of the header portion 2*a* (2*b*) and substantially equal to the entire lengths (=W1) of the first side surfaces 1*b* in the direction Y. Second sides 32 of the first spacer 30*a* each have a length more than the width W2 of the header portion 2*c* in the direction Z along the second side surfaces 1*c*, and extend from an end closer to one of the first side surfaces 1*b* to the gap portion 3*b*. Second sides 32 of the first spacer 30*b* each have a length more than the width W2 of the header portion 2*d* in the direction Z along the second side surfaces 1*c*, and extend from an end closer to the other of the first side surfaces 1*b* to the gap portion 3*c*. Internal sides 33 of the first spacers 30*a* and 30*b* are along the gap portions 3*b* and 3*c*, respectively.

Thus, the first spacer 30*a* functions as a partition wall that partitions an interior space of the header portion 2*a* and a gap CL (an arrangement region of each of the spacer portions 3) between the bonded surfaces 1*a* of the cores 1 by the first side 31 (and a welded portion of the first side 31), and functions as a partition wall that partitions an interior space of the header portion 2*c* and the gap CL between the bonded surfaces 1*a* of the cores 1 by the second side 32 (and a welded portion of the second side 32) on the Y1 side. The first spacer 30*b* functions as a partition wall that partitions an interior space of the header portion 2*b* and the gap CL between the bonded surfaces 1*a* of the cores 1 by the first side 31 (and the welded portion), and functions as a partition wall that partitions an interior space of the header portion 2*d* and the gap CL between the bonded surfaces 1*a* of the cores 1 by the second side 32 (and the welded portion) on the Y1 side.

The second spacer 30*c* is provided between a pair of first spacers 30*a* and 30*b*. The second spacer 30*c* is arranged apart from the pair of first spacers 30*a* and 30*b* through the gap portions 3*b* and 3*c*, respectively. A pair of sides 34 of the second spacer 30*c* extending in the direction Y has a length substantially equal to the width W1 of the header portion 2*a* (2*b*) and substantially equal to the entire lengths (=W1) of the first side surfaces 1*b* in the direction Y. A pair of sides 35 of the second spacer 30*c* extending in the direction Z is along the outer peripheral edges (sides) of the bonded surfaces 1*a* closer to the second side surfaces 1*c*, and the length thereof in the direction Z is equal to a distance between the gap portion 3*b* and the gap portion 3*c*.

In this manner, according to the first embodiment, the outer peripheral portions 3*a* of the spacer portions 3 are constituted by the respective first sides 31 and second sides 32 of the first spacers 30*a* and 30*b* and the sides 35 of the second spacers 30*c* extending in the direction Z, and are circumferentially formed over the substantially entire circumferences (entire circumferences excluding portions on which the gap portions 3*b* and 3*c* are located) of the outer peripheral edges of the bonded surfaces 1*a* as a whole. Thus, weld sites between the cores 1 and the spacer portions 3 are substantially entire circumferences of the outer peripheral edges of the bonded surfaces 1*a* excluding the portions on which the gap portions 3*b* and 3*c* are located. In other words, weld lines formed by welding are broken at the portions on which the gap portions 3*b* and 3*c* are located. In other words, ends (starting points or end points) of the weld sites are located at the gap portions 3*b* and 3*c*.

According to the first embodiment, the gap portions 3*b* and 3*c* are provided at positions where a temperature gradient on the bonded surfaces 1*a* of the cores 1 is relatively shallow. However, the temperature gradient varies by the operational conditions (the temperatures (the inlet temperature, the outlet temperature) of two types of fluids, the types, flow rates, working pressures, etc. of the fluids) of the heat exchanger 100. Thus, the temperature gradient is obtained by a simulation or the like according to these operational conditions.

Figure 7:
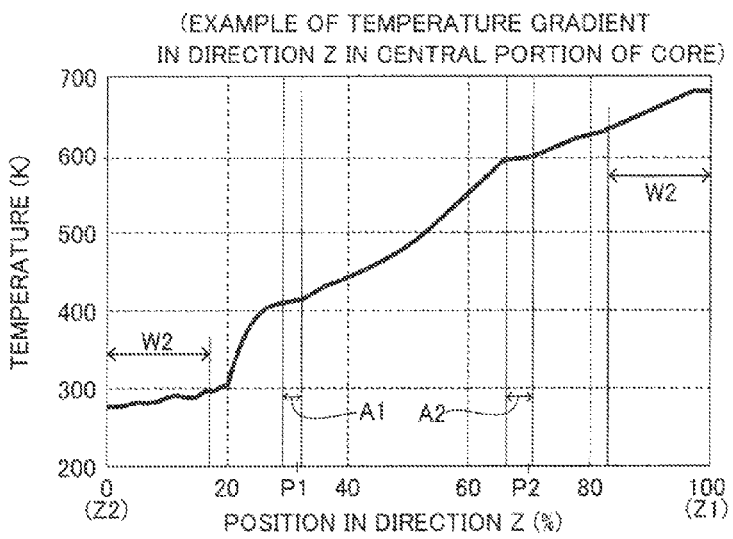
FIG. 7 An example of a temperature-position curve diagram for illustrating a temperature gradient in the core.

The temperature gradient is mainly generated in a direction along the flow direction of the fluids flowing through the flow path portions 14 (a direction in which the flow path portions 14 extend (the longitudinal direction of the cores 1)). Therefore, in the case of the first embodiment, the positions of the gap portions (3*b* and 3*c*) can be determined by the temperature gradient in the direction Z. An example of the temperature gradient in the direction Z (the longitudinal direction of the cores 1) in central portions in the direction Y is shown in FIG. 7. In FIG. 7, a position in the direction Z is shown by percentage, assuming a Z2-side end of the bonded surface 1*a* as 0% and a Z1-side end of the bonded surface 1*a* as 100%. It is found that the vertical axis represents absolute temperature (K), and as the slope of a graph is small, a temperature gradient in the direction Z is shallow. In the example shown in FIG. 7, the temperature gradient is relatively shallow (the slope is small) in regions shown by A1 and A2 as compared with other sites. The positions of the gap portions 3*b* and 3*c* correspond to positions P1 and P2 in the regions A1 and A2, respectively. When there are three or more regions in which the temperature gradient is shallow or regions in which the temperature gradient is shallow exist over a wide range, for example, the gap portions 3*b* and 3*c* are arranged at positions that are different from regions in which the header portions 2 (2*a* to 2*d*) are arranged and are closer to the header portions 2 (2*a* to 2*d*) in the regions in which the temperature gradient is relatively shallow. The regions in which the header portions 2 are arranged correspond to ranges with a width W2 on the Z2 side (header portion 2*d*) and a width W2 on the Z1 side (header portion 2*c*). In this manner, the positions in which the gap portions 3*b* and 3*c* are arranged are determined.

According to the first embodiment, the positions in which the gap portions 3*b* and 3*c* are arranged are located at substantially the same distance from the first side surfaces 1*b* on the Z1 side and the first side surfaces 1*b* on the Z2 side, respectively, but the positions in which the gap portions 3*b* and 3*c* are arranged may be at completely different distances. Thus, the lengths of the second sides 32 of the first spacer 30*a* and the lengths of the second sides 32 of the first spacer 30*b* may be different from each other.

The gap portions 3*b* and 3*c* are provided to pass through regions between the first spacers 30*a* and 30*b* and the second spacer 30*c* from one of the second side surfaces 1*c* to the other of the second side surfaces 1*c* on each of the bonded surfaces 1*a* of the cores 1. As shown in FIG. 5, both the gap portions 3*b* and 3*c* are provided to linearly extend in the direction Y with groove widths W3 less than the width W1 of the header portion 2*a* (2*b*), the width W2 of the header portion 2*c* (2*d*), and the lengths of the sides 32 and sides 35. The groove widths W3 of the gap portions 3*b* and 3*c* are preferably less than the widths of the regions (A1 and A2 in FIG. 7) in which the temperature gradient is relatively shallow, and both ends (the ends of the weld sites) of the gap portions 3*b* and 3*c* in a width direction are preferably arranged to fit into the regions (A1 and A2 in FIG. 7) in which the temperature gradient is relatively shallow. The groove widths of the gap portions 3*b* and 3*c* may be different in magnitude from each other.

The functions of the gap portions 3*b* and 3*c* are now described.

As described above, in the first spacers 30*a* and 30*b*, the weld sites of the first sides 31 and the second sides 32 function as the partition walls that partition the interior spaces of the header portions 2 (2*a* to 2*d*) and the gap CL (the region in which each of the spacer portions 3 is arranged) between the bonded surfaces 1*a* of the cores 1. Thus, when there is poor weld, the interior spaces of the header portions 2 and the gap CL between the bonded surfaces 1*a* of the cores 1 may be communicated with each other, and leakage of the fluids from the interior spaces of the header portions 2 to the gap CL between the bonded surfaces 1*a* of the cores 1 (the region in which each of the spacer portions 3 is arranged) may occur.

As shown in FIG. 5, taking the case where the poor weld leading to the leakage occurs in a welded portion at a position P3 on the first side 31 of the first spacer 30*a* as an example, the leaking fluids pass through a small gap formed between the bonded surface 1*a* and the first spacer 30*a*. However, the remaining portions of the outer peripheral portion of the first spacer 30*a* are welded, and hence the leaking fluids can only be leaked to the Z2 side, and reach the gap portion 3*b*. The gap portion 3*b* is a linear flow path, and hence occurrence of the leakage of the fluids from the first spacer 30*a* can be easily determined by detecting the fluids that flow out of the gap portion 3*b*. Similarly, when the poor weld leading to the leakage occurs in the first spacer 30*b*, the leaking fluids reach the gap portion 3*c*, and hence the leakage of the fluids from the first spacer 30*b* through the gap portion 3*c* can be easily determined.

Thus, outlets (portions that intersect with the outer peripheral edge of the bonded surface 1*a*) of the gap portions 3*b* and 3*c* are blocked by cover plates 5, as shown in FIG. 5. The cover plates 5 include openable and closable detection holes 5*a*, and the detection holes 5*a* are generally closed. At the time of leakage testing, the detection holes 5*a* of the cover plates 5 are opened, and the leaking fluids can be detected through the detection holes 5*a*.

The flow of the fluids in the heat exchanger 100 is now described with reference to FIG. 4.

The first fluid flows into the inflow/outflow port 21*a* of the header portion 2*a*. Then, the first fluid flowing in from the header portion 2*a* flows through the cores 1 (flow path portions 14) vertically downward (in a direction Z2), flows to the Y2-direction side in an L-shape, and flows out through the inflow/outflow port 21*d* of the header portion 2*d*. The second fluid flows into the inflow/outflow port 21*c* of the header portion 2*c*. Then, the second fluid flowing in from the header portion 2*c* flows through the cores 1 (flow path portions 14) to the Y2-direction side, flows vertically downward (in the direction Z2) in an L-shape, and flows out through the inflow/outflow port 21*b* of the header portion 2*b*.

According to the first embodiment, the following effects can be obtained.

According to the first embodiment, as hereinabove described, the outer peripheral portions 3*a* circumferentially provided along the outer peripheral edges of the bonded surfaces 1*a* of the cores 1 and the gap portions 3*b* and 3*c* provided in the partial regions of the circumferential outer peripheral portions 3*a* are provided in the spacer portions 3, whereby the weld sites between the spacer portions 3 and the cores 1 (i.e. the outer peripheral portions 3*a* of the spacer portions 3) can be circumferentially formed along the outer peripheral edges of the bonded surfaces 1*a* while the gap portions 3*b* and 3*c* are ensured. Consequently, the leakage of the fluids can be easily detected through the gap portions 3*b* and 3*c*, and the circumferential weld sites enable an increase in bond areas between the spacer portions 3 and the cores 1 so that the bonding strength can be improved. Furthermore, the gap portions 3*b* and 3*c* are provided at positions (the regions A1 and A2 in FIG. 7) where the temperature gradient on the bonded surfaces 1*a* of the cores 1 is relatively shallow, considering that the ends (the starting points or the end points of welding) of the weld sites in which a stress is likely to be concentrated are located in the gap portions 3*b* and 3*c*, whereby the ends (the gap portions 3*b* and 3*c*) of the weld sites can also be arranged at the positions where the temperature gradient is relatively shallow. Thus, the ends of the weld sites can be arranged in regions of the bonded surfaces 1*a* in which a stress caused by deformation following a temperature change is relatively small, and hence an increase in stress can be suppressed even if a stress is concentrated in the ends of the weld sites. Thus, the bonding strength between the spacer portions 3 and the cores 1 can be improved while an increase in stress in the ends (the gap portions 3*b* and 3*c*) of the weld sites can be suppressed, and hence the spacer portions 3 can sufficiently withstand a stress under operational conditions where a temperature difference between a high-temperature side and a low-temperature side is large.

According to the first embodiment, as hereinabove described, the first spacers 30*a* and 30*b* each having a rectangular plate shape and provided in the outer peripheral edges of the bonded surfaces 1*a* of the cores 1 and the regions inside the outer peripheral edges of the bonded surfaces 1*a* are provided in the spacer portions 3. Thus, the spacer portions (the first spacers 30*a* and 30*b*) themselves can be rendered robust to an increase in stress caused by the deformation of the bonded surfaces 1*a* of the cores 1.

According to the first embodiment, as hereinabove described, the outer peripheral portions (the first sides 31 and the second sides 32) of the first spacers 30*a* and 30*b* each having a rectangular plate shape are arranged along the three sides of the outer peripheral edges of the bonded surfaces 1*a* of the cores 1. Thus, the large-size first spacer portions 30*a* and 30*b* each having a rectangular plate shape can be provided, and the weld sites of the first spacers 30*a* and 30*b* can be formed in a wide range over the three sides of the outer peripheral edges of the bonded surfaces 1*a* of the cores 1. Consequently, the stiffness of the first spacers 30*a* and 30*b* themselves and the bonding strength between the first spacers 30*a* and 30*b* and the cores 1 can be further improved. When the cores 1 and the spacer portions 3 are welded to each other, ends of the flow path portions 14 in the vicinity of the bonded surfaces 1*a* may be deformed due to heat during the welding. On the other hand, according to the first embodiment, the stiffness of the first spacers 30*a* and 30*b* is improved, and hence deformation of the ends of the flow path portions 14 during welding can also be suppressed.

According to the first embodiment, as hereinabove described, on the bonded surface 1*a*, the first side 31 of the first spacer 30*a* (30*b*) having a rectangular plate shape, which is closer to the first side surface 1*b*, has a length equal to or more than the width W1 of the header portion 2*a* (2*b*), and the second side 32 of the first spacer 30*a* (30*b*), which is closer to the second side surface 1*c*, has a length equal to or more than the width W2 of the header portion 2*c* (2*d*), and extends to the gap portion 3*b* (3*c*). Thus, even when there is poor weld leading to leakage, the leaking fluids passing between the first spacer 30*a* (30*b*) and the bonded surface 1*a* can be sent to the gap portion 3*b* (3*c*). Consequently, the leakage from the weld sites of the first spacers 30*a* and 30*b* can be checked simply by detecting the fluids in the gap portions 3*b* and 3*c* at the time of leakage testing, and hence the leakage of the fluids can be easily detected even when the first spacers 30*a* and 30*b* are increased in size.

According to the first embodiment, as hereinabove described, on the bonded surface 1*a* of the core 1, the pair of first spacers 30*a* and 30*b* provided closer to a pair of first side surfaces 1*b* that sandwiches the bonded surface 1*a* therebetween, respectively, and the second spacer 30*c* having a rectangular plate shape and arranged through the gap portions 3*b* and 3*c* with respect to the pair of first spacers 30*a* an 30*b* are provided in each of the spacer portions 3. Thus, the spacer portions 3 can be provided in a wide range over the substantially entire bonded surfaces 1*a* of the cores 1, and hence the stiffness of the entire spacer portions 3 and the bonding strength between the spacer portions 3 and the cores 1 can be improved. Also in this case, the leakage of the fluids occurring in each of the pair of first spacers 30*a* an 30*b* can be detected from the respective gap portions 3*b* and 3*c* between the first spacers 30*a* and 30*b* and the second spacer 30*c*, and hence the leakage of the fluids can be easily detected.

According to the first embodiment, as hereinabove described, on the bonded surface 1*a* of the core 1, the gap portions 3*b* and 3*c* are provided to pass through the regions between the first spacers 30*a* and 30*b* and the second spacer 30*c* from one of the second side surfaces 1*c* to the other of the second side surfaces 1*c*. Thus, the gap portions 3*b* and 3*c* as flow paths for detecting the leaking fluids are formed in a simple shape, whereby the leaking fluids can be promptly guided to the outside of the gap portions 3*b* an 3*c*, and the leaking fluids can be easily detected from the sides of the second side surfaces 1*c*.

According to the first embodiment, as hereinabove described, the gap portions 3*b* and 3*c* are arranged at the positions that are different from the regions in which the header portions 2 (2*a* to 2*d*) are arranged and that are closer to the header portions 2 (2*a* to 2*d*) in the regions in which the temperature gradient on the bonded surfaces 1*a* of the cores 1 is relatively shallow. Thus, distances between the header portions 2 (2*a* to 2*d*) and the gap portions 3*b* and 3*c* can be reduced. Therefore, the fluids leaking from the sides of the header portions 2 (2*a* to 2*d*) through the spacer portions 3 can be more easily and reliably detected while the influence of a temperature change on the ends (the gap portions 3*b* and 3*c*) of the weld sites is suppressed.

Second Embodiment

A second embodiment is now described with reference to FIG. 8. In this second embodiment, an example of a heat exchanger 200 provided with spacer portions 103 different from the aforementioned first embodiment in which the spacer portions 3 are constituted by the first spacers 30*a* and 30*b* each having a rectangular plate shape and the second spacers 30*c* each having a rectangular plate shape is described. Structures of the heat exchanger 200 according to the second embodiment other than the structure of the spacer portions 103 are similar to those of the aforementioned first embodiment, and hence the structures are denoted by the same reference numerals, to omit the description.

Figure 8:
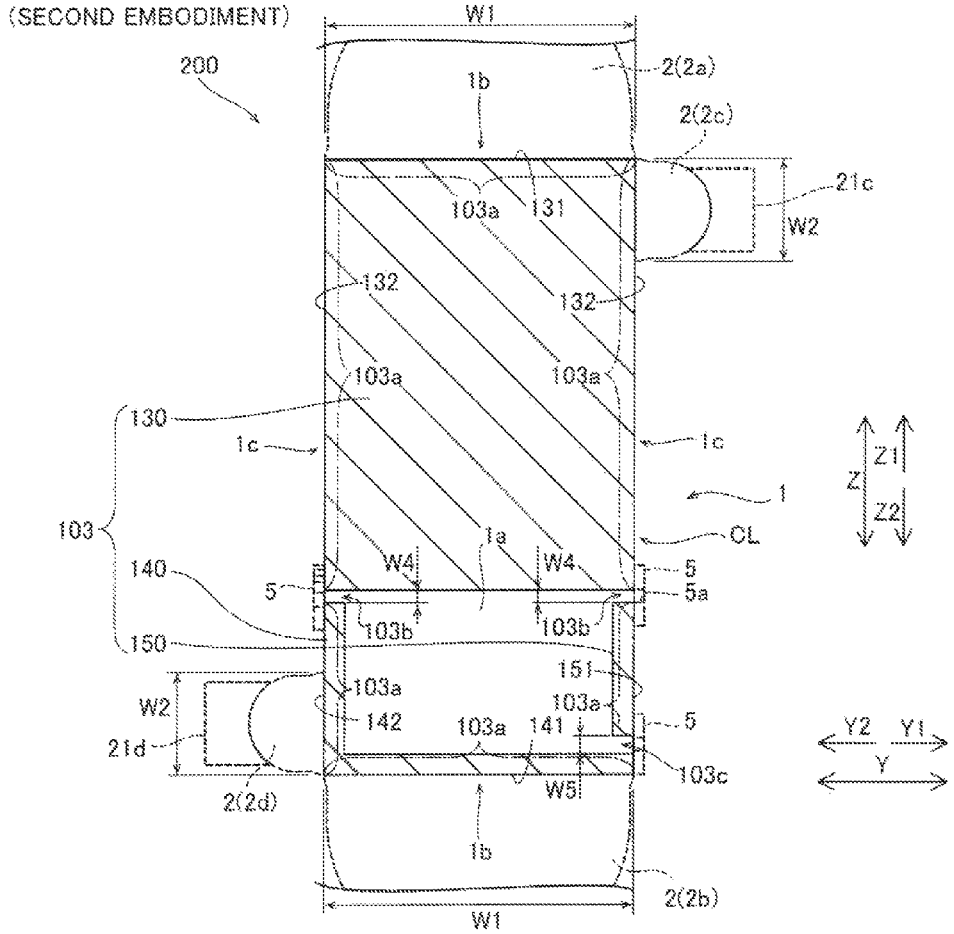
FIG. 8 A diagram of a bonded surface side of a core for illustrating the structure of a spacer portion of a heat exchanger according to a second embodiment of the present invention.

As shown in FIG. 8, the spacer portions 103 of the heat exchanger 200 according to the second embodiment are constituted by first spacers 130 each having a rectangular plate shape, L-shaped spacers 140, and linear spacers 150. According to the second embodiment, gap portions 103*b* and 103*c* both are arranged at positions near first side surfaces 1*b* closer to second ends (Z2 side) than first ends (Z1 side) in the longitudinal direction of cores 1.

The first spacers 130 each are provided in the outer peripheral edge of a bonded surface 1*a* of a core 1 and a region inside the outer peripheral edge. The outer peripheral portion of each of the first spacers 130 is provided along the outer peripheral edge (side) of the bonded surface 1*a* of the core 1 closer to a first side surface 1*b* on the Z1 side and the outer peripheral edges (sides) of the bonded surface 1*a* of the core 1 closer to both of second side surfaces 1*c*. Specifically, a first side 131 of each of the first spacers 130 closer to the first side surface 1*b* has a length substantially equal to the width W1 (i.e. the entire length of the first side surface 1*b* in a direction Y (the short-side direction of the core 1)) of a header portion 2*a*. Second sides 132 of each of the first spacers 130 closer to the second side surfaces 1*c* each have a length more than the width W2 of a header portion 2*c* in a direction Z (the longitudinal direction of the core 1), and extend from an end closer to one of the first side surfaces 1*b* to the gap portion 103*b*. Unlike the aforementioned first embodiment, the second sides 132 each have a length equal to or more than a half of the outer peripheral edge closer to each of the second side surfaces 1*c*, which extends in the direction Z.

The L-shaped spacers 140 each are provided along two sides of the outer peripheral edge of the bonded surface 1*a* of the core 1 closer to a first side surface 1*b* on the Z2 side and the outer peripheral edge of the bonded surface 1*a* of the core 1 closer to a second side surface 1*c* on a Y2 side. Therefore, the spacers 140 each are provided along the outer peripheral edge of the bonded surface 1*a* of the core 1, but not provided in the region inside the outer peripheral edge. A side 141 of each of the spacers 140 closer to the first side surface 1*b* has a length substantially equal to the width W1 (i.e. the entire length of the first side surface 1*b* in the direction Y) of the header portion 2*a*. A side 142 of each of the spacers 140 closer to the second side surface 1*c* has a length more than the width W2 of a header portion 2*d*, and extends from an end closer to the first side surface 1*b* on the Z2 side to the gap portion 103*b*.

The linear spacers 150 each have a narrow plate shape provided along the outer peripheral edge (side) of the bonded surface 1*a* of the core 1 closer to a second side surface 1*c* on a Y1 side. Therefore, the spacers 150 each are provided along the outer peripheral edge of the bonded surface 1*a* of the core 1, but not provided in the region inside the outer peripheral edge. A side 151 of each of the spacers 150 extends from the gap portion 103*b* to the gap portion 103*c* in the direction Z.

Thus, the first spacers 130 each function as a partition wall that partitions an interior space of the header portion 2*a* and a gap CL between bonded surfaces 1*a* of the cores 1, and function as a partition wall that partitions an interior space of the header portion 2*c* and the gap CL between the bonded surfaces 1*a* of the cores 1. The spacers 140 each function as a partition wall that partitions an interior space of the header portion 2*b* and the gap CL between the bonded surfaces 1*a* of the cores 1, and function as a partition wall that partitions an interior space of the header portion 2*d* and the gap CL between the bonded surfaces 1*a* of the cores 1.

According to the second embodiment, the outer peripheral portions 103*a* of the spacer portions 103 are constituted by the first sides 131 and the second sides 132 of the first spacers 130, the sides 141 and the sides 142 of the spacers 140, and the sides 151 of the spacers 150, and are circumferentially formed over the substantially entire circumferences (entire circumferences excluding portions on which the gap portions 103*b* and 103*c* are located) of the outer peripheral edges of the bonded surfaces 1*a* as a whole.

On the bonded surface 1*a* of the core 1, the gap portions 103*b* and 103*c* are provided at positions closer to one (Z2 side) of a pair of first side surfaces 1*b*, which is orthogonal to the bonded surface 1*a* and sandwiches the bonded surface 1*a* therebetween, than the other (Z1 side) of the pair of first side surfaces 1*b* in a region in which a temperature gradient is relatively shallow in the bonded surface 1*a* of the core 1. The gap portion 103*b* is provided at a position on the Z1 side with respect to the header portion 2*d* and closer to the header portion 2*d* in a region in which the temperature gradient is relatively shallow in the bonded surface 1*a* of the core 1. The gap portion 103*c* is arranged on the Y1 side opposite to the header portion 2*d* and in the vicinity of the first side surface 1*b* on the Z2 side.

The gap portions 103*b* and 103*c* have widths W4 and W5, respectively, less than the width W1 of the header portion 2*a* (2*b*), the width W2 of the header portion 2*c* (2*d*), and the lengths of the sides 132, the side 142, and the side 151. According to the second embodiment, in inner regions of the bonded surfaces 1*a*, spaces surrounded by the first spacers 130 and the spacers 140 and 150 are formed, and the gap portions 103*b* and 103*c* are communicated with each other. The groove width W4 of the gap portion 103*b* and the groove width W5 of the gap portion 103*c* each are preferably less than the width of the region in which the temperature gradient is relatively shallow, and both ends (ends of weld sites) of the gap portions 103*b* and 103*c* in a width direction are preferably arranged to fit into the region in which the temperature gradient is relatively shallow.

The remaining structures of the second embodiment are similar to those of the aforementioned first embodiment.

According to the second embodiment, the following effects can be obtained.

According to the second embodiment, the outer peripheral portions 103*a* circumferentially provided along the outer peripheral edges of the bonded surfaces 1*a* of the cores 1 and the gap portions 103*b* and 103*c* provided in partial regions of the circumferential outer peripheral portions 103*a* are provided in the spacer portions 103. The gap portions 103*b* and 103*c* are provided at positions where the temperature gradient on the bonded surface 1*a* of the core 1 is relatively shallow. Thus, similarly to the aforementioned first embodiment, leakage of fluids can be easily detected, and the spacer portions 103 can sufficiently withstand a stress under operational conditions where a temperature difference between a high-temperature side and a low-temperature side is large.

According to the second embodiment, as hereinabove described, on the bonded surface 1*a* of the core 1, the gap portions 103*b* and 103*c* are provided at the positions closer to one (Z2 side) of the first side surfaces 1*b* than the other (Z1 side) of the first side surfaces 1*b* in the region in which the temperature gradient is relatively shallow. Furthermore, each of the first spacers 130 having a rectangular plate shape extends from the end closer to the other (Z1 side) of the first side surfaces 1*b* to the gap portion 103*b* closer to one (Z2 side) of the first side surfaces 1*b* on the bonded surface 1*a* of the core 1. Thus, the large-size first spacers 130 over a wide range from the end closer to the other (Z1 side) of the first side surfaces 1*b* to the gap portion 103*b* closer to one (Z2 side) of the first side surfaces 1*b* can be provided, and hence the stiffness of the first spacers 130 can be further improved. Also in this case, leakage from the weld sites of the first spacers 130 can be checked simply by detecting the fluids in the gap portions 103*b* and 103*c*, and hence the leakage of the fluids can be easily detected.

The remaining effects of the second embodiment are similar to those of the aforementioned first embodiment.

(Simulation)

Results of a simulation for illustrating the effects of the heat exchanger 100 according to the aforementioned first embodiment and the heat exchanger 200 according to the aforementioned second embodiment are now described. As an example of operational conditions where a temperature difference between a high-temperature side and a low-temperature side is large, a simulation of distribution of stress acting on the spacer portions in the example of the temperature gradient in the direction Z in the heat exchanger shown in FIG. 7.

Figure 11:
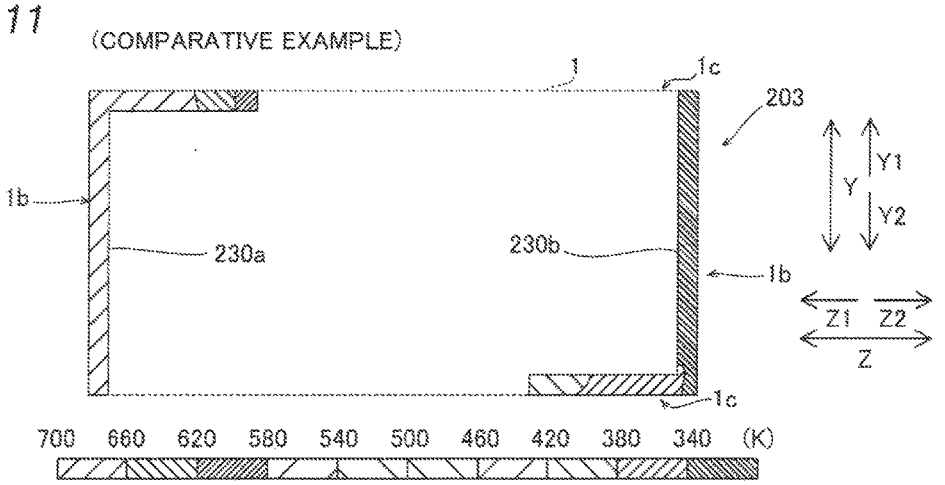
FIG. 11 A temperature distribution chart showing an example of operational conditions where a temperature difference between a high-temperature side and a low-temperature side is large according to a comparative example.

In this simulation, as a comparative example, a spacer portion 203 shown in FIG. 11 was also examined. The comparative example is an example of providing two L-shaped spacers 230*a* and 230*b* to cover only portions in which header portions 2 (2*a* to 2*d*) are placed (see FIG. 5). The spacer 230*a* is provided along the outer peripheral edge of a bonded surface 1*a* corresponding to the header portions 2*a* and 2*c* (see FIG. 5). The spacer 230*b* is provided along the outer peripheral edge of the bonded surface 1*a* corresponding to the header portions 2*b* and 2*d* (see FIG. 5).

Figure 9:
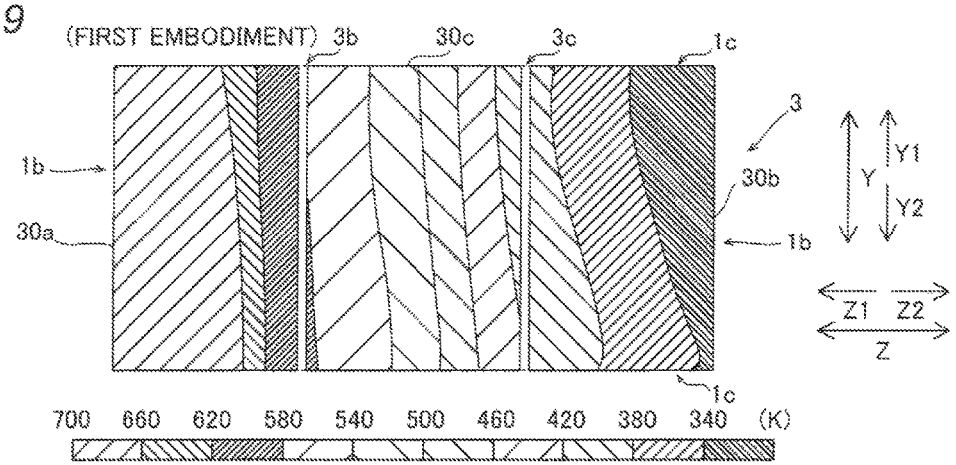
FIG. 9 A temperature distribution chart showing an example of operational conditions where a temperature difference between a high-temperature side and a low-temperature side is large in the heat exchanger according to the first embodiment of the present invention.
Figure 10:
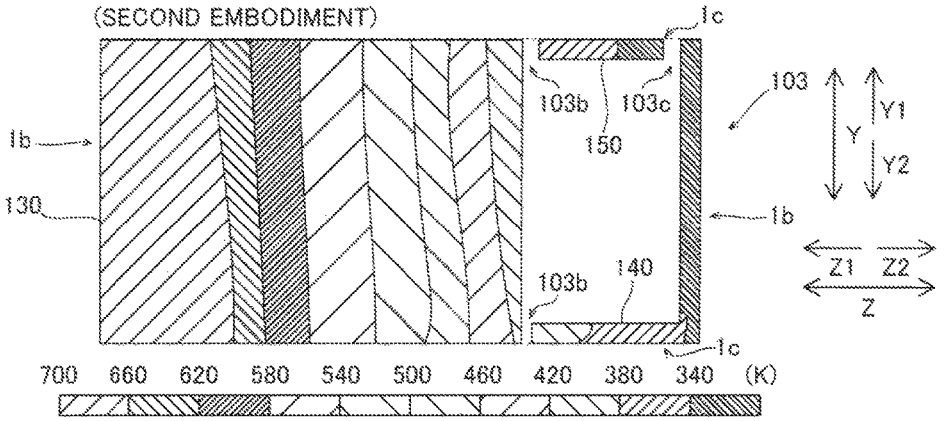
FIG. 10 A temperature distribution chart showing an example of operational conditions where a temperature difference between a high-temperature side and a low-temperature side is large in the heat exchanger according to the second embodiment of the present invention.

FIGS. 9, 10, and 11 show a temperature distribution on each of the spacer portions 3 of the heat exchanger 100 according to the first embodiment, a temperature distribution on each of the spacer portions 103 of the heat exchanger 200 according to the second embodiment, and a temperature distribution on the spacer portion 203 according to the comparative example, respectively. Temperature is illustrated by dividing a temperature range from less than 340 K to 700 K in terms of absolute temperature into 10 stages every 40 K and differently hatching the stages. The temperature distributions on the spacer portions in FIGS. 9, 10, and 11 are substantially similar. It is found from FIGS. 9 and 10 that the gap portions 3*b* and 3*c* (103*b* and 103*c*) are arranged to fit into the same region of the temperature range, and the gap portions 3*b* and 3*c* (103*b* and 103*c*) are arranged at the positions where the temperature gradient is relatively shallow.

Figure 12:
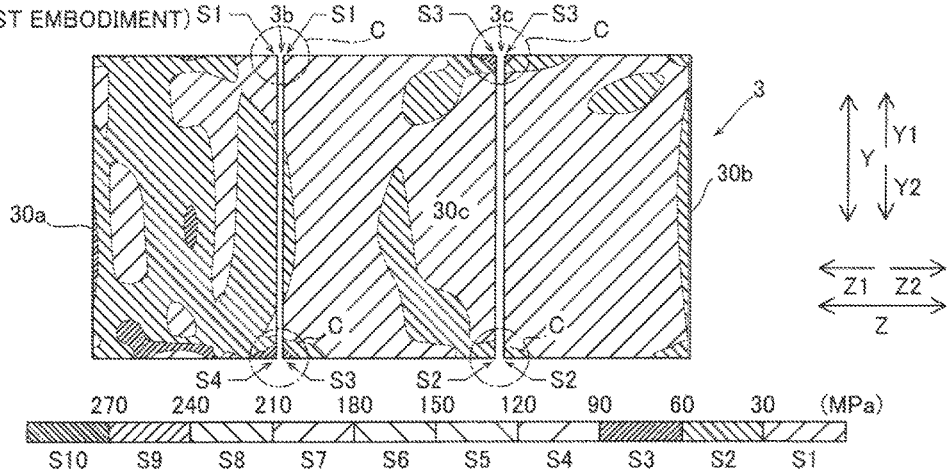
FIG. 12 A diagram showing a simulation result of a stress distribution for a temperature distribution shown in FIG. 9 on the spacer portion according to the first embodiment.
Figure 13:
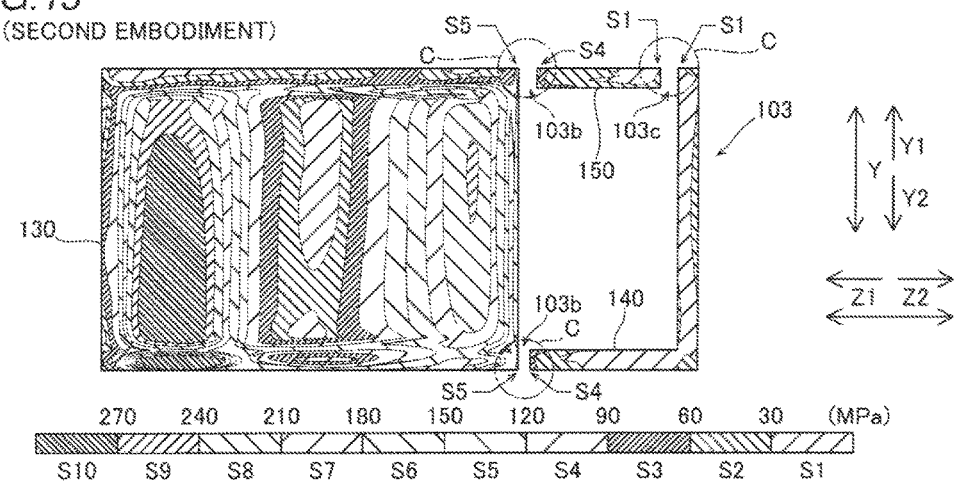
FIG. 13 A diagram showing a simulation result of a stress distribution for a temperature distribution shown in FIG. 10 on the spacer portion according to the second embodiment.
Figure 13:
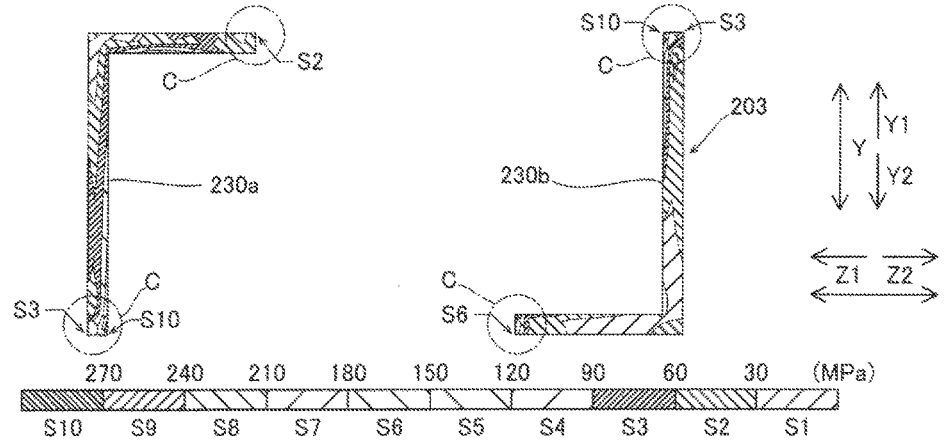

FIGS. 12, 13, and 14 show a stress distribution on each of the spacer portions 3 of the heat exchanger 100 according to the first embodiment, a stress distribution on each of the spacer portions 103 of the heat exchanger 200 according to the second embodiment, and a stress distribution on the spacer portion 203 according to the comparative example, respectively. Stress is illustrated by dividing a stress range from less than 30 MPa (S1) to at least 270 MPa (S10) into 10 stages (S1 to S10) every 30 MPa and differently hatching the stages.

The weld sites of the spacer portions are linearly provided along the outer peripheral portions, and hence ends C (the starting points or the end points of welding) of the weld sites have the lowest strength. The ends C of the weld sites are the positions of the gap portions 3*b* and 3*c* in FIG. 12 (the spacer portions 3), the positions of the gap portions 103*b* and 103*c* in FIG. 13 (the spacer portions 103), and both ends of the spacer 230*a* (230*b*) in FIG. 14 (the spacer portion 203).

When stresses in these ends C are compared with each other, in the case of the spacer portions 3 of the heat exchanger 100 according to the first embodiment, a stress is kept to a level of S1 to S4, which is less than 120 MPa, at each of the positions of the gap portions 3*b* and 3*c*, as shown in FIG. 12. In the case of the spacer portions 103 of the heat exchanger 200 according to the second embodiment, a stress is kept to a level of S1 to S5, which is less than 150 MPa, at each of the gap portions 103*b* and 103*c*, as shown in FIG. 13.

On the other hand, in the case of the comparative example shown in FIG. 14, it is found that a stress is increased to a level of S10 (at least 270 MPa) particularly in a Y2 side end of the spacer 230*a* and a Y1 side end of the spacer 230*b* as to both ends of the spacer 230*a* (230*b*).

Thus, in the heat exchanger 100 according to the aforementioned first embodiment and the heat exchanger 200 according to the aforementioned second embodiment, stresses in the gap portions (3*b*, 3*c*, 103*b*, and 103*c*) are reduced so that the spacer portions can also sufficiently withstand a stress under the operational conditions where a temperature difference between a high-temperature side and a low-temperature side is large.

Although cannot be seen in the stress distributions in FIGS. 12 and 13, the spacers are shaped into a large-size rectangular plate as the first spacers 30*a* and 30*b* and the second spacers 30*c* of the heat exchanger 100 according to the first embodiment and the first spacers 130 of the heat exchanger 200 according to the second embodiment, whereby the stiffness of the spacers themselves are improved. Thus, as to theses spacers, portions other than the ends of the weld sites can withstand a higher stress as well.

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the example of the heat exchanger in which two types of fluids, the first fluid and the second fluid, flow through the cores 1 has been shown in each of the aforementioned first and second embodiments, the present invention is not restricted to this. According to the present invention, three or more types of fluids may flow through the cores.

While the example in which a total of four gap portions 3*b* and 3*c* are provided in the outer peripheral edges of the bonded surfaces has been shown in the aforementioned first embodiment and the example in which a total of three gap portions 103*b* and 103*c* are provided in the outer peripheral edges of the bonded surfaces has been shown in the aforementioned second embodiment, the present invention is not restricted to this. One, two, five, or more gap portions may be provided in the outer peripheral edges.

While the example in which the gap portions 3*b* and 3*c* are linearly provided to penetrate from one of the second side surfaces to the other of the second side surfaces has been shown in the aforementioned first embodiment, the present invention is not restricted to this. The gap portions may not penetrate but may be provided on both sides closer to the second side surfaces. Furthermore, the gap portions may be provided in a curved line.

While the example of providing the first spacers (30*a*, 30*b*, 130) each having a rectangular plate shape has been shown in each of the aforementioned first and second embodiments, the present invention is not restricted to this. According to the present invention, the first spacers each may have a shape other than the rectangular shape. Particularly, the shapes of inner portions (sides 33; see FIG. 5) not along the outer peripheral edges of the bonded surfaces are arbitrary.

While the example of providing the first spacers (30*a*, 30*b*, 130) along the three sides of the outer peripheral edges of the bonded surfaces has been shown in each of the aforementioned first and second embodiments, the present invention is not restricted to this. According to the present invention, the first spacers each may have a shape along only two sides of the outer peripheral edges.

While the example in which the lengths of the first sides (31, 131) of the first spacers are substantially equal to the entire lengths of the outer peripheral edges closer to the first side surfaces has been shown in each of the aforementioned first and second embodiments, the present invention is not restricted to this. When the header portions are mounted on only portions of the first side surfaces, the lengths of the first sides of the first spacers may be smaller than the entire lengths of the outer peripheral edges closer to the first side surfaces so far as the same are equal to or more than the widths of the header portions. More specifically, as shown in FIG. 5, the only requirement is that the first sides 31 of the first spacers 30*a* and 30*b* closer to the first side surfaces 1*b* each have a length equal to or more than the width W1 of the header portion 2*a* (2*b*) on the bonded surfaces 1*a*. The same holds true for the first spacers 130 shown in FIG. 8.

While the example in which the spacer portions 3 each are constituted by a total of three members, the two first spacers 30*a* and 30*b* and the single second spacer 30*c*, has been shown in the aforementioned first embodiment and the example in which the spacer portions 103 each are constituted by a total of three members, the single first spacer 130 and the two spacers 140 and 150, has been shown in the aforementioned second embodiment, the present invention is not restricted to this. According to the present invention, any number of spacers constituting the spacer portions may be employed.

DESCRIPTION OF REFERENCE SIGNS

1 Core
1*a* Bonded surface
1*b* First side surface
1*c* Second side surface
2 Header portion
2*a*, 2*b* Header portion (first header portion)
2*c*, 2*d* Header portion (second header portion)
3, 103 Spacer portion
3*a*, 103*a* Outer peripheral portion
3*b*, 3*c*, 103*b*, 103*c* Gap portion
14 Flow path portion
30*a*, 30*b*, 130 First spacer
30*c* Second spacer
31, 131 First side
32, 132 Second side
W1 Width of the header portion
W2 Width of the header portion
100, 200 Heat exchanger

The invention claimed is:

1. A heat exchanger comprising:

multiple cores in which flow path portions through which multiple types of fluids flow are alternately stacked; and a spacer portion arranged between bonded surfaces of the cores adjacent to each other and integrally fixed to the cores on both sides by welding, wherein the spacer portion includes an outer peripheral portion circumferentially provided along outer peripheral edges of the bonded surfaces of the cores and a gap portion provided in a partial region of the circumferential outer peripheral portion, and the gap portion is provided at a position where a temperature gradient on the bonded surfaces of the cores is relatively shallow.

2. The heat exchanger according to claim 1, wherein the spacer portion includes a first spacer having a rectangular plate shape and provided on the outer peripheral edges of the bonded surfaces of the cores and regions inside the outer peripheral edges of the bonded surfaces.

3. The heat exchanger according to claim 2, wherein the bonded surfaces of the cores each have a rectangular shape, and an outer peripheral portion of the first spacer having the rectangular plate shape is arranged along three sides of the outer peripheral edges of the bonded surfaces of the cores.

4. The heat exchanger according to claim 2, further comprising a first header portion provided on first side surfaces of the cores orthogonal to the bonded surfaces and a second header portion provided on second side surfaces of the cores orthogonal to the first side surfaces and the bonded surfaces, wherein on the bonded surfaces, a first side of the first spacer having the rectangular plate shape, which is closer to the first side surfaces, has a length equal to or more than a width of the first header portion, and a second side of the first spacer, which is closer to the second side surfaces, has a length equal to or more than a width of the second header portion, and extends to the gap portion.

5. The heat exchanger according to claim 4, wherein on the bonded surfaces of the cores, the spacer portion includes a pair of the first spacers provided closer to a pair of the first side surfaces that sandwiches each of the bonded surfaces therebetween, respectively, and a second spacer having a rectangular plate shape, provided between the pair of first spacers, and arranged through the gap portion with respect to each of the pair of first spacers.

6. The heat exchanger according to claim 5, wherein on the bonded surfaces of the cores, the gap portion is provided to pass through a region between the first spacer and the second spacer from one of the second side surfaces to the other of the second side surfaces.

7. The heat exchanger according to claim 2, wherein on the bonded surfaces of the cores, the gap portion is provided at a position closer to one of a pair of first side surfaces, which is orthogonal to the bonded surfaces and sandwiches each of the bonded surfaces therebetween, than the other of the pair of first side surfaces in a region in which the temperature gradient is relatively shallow in the bonded surfaces of the cores, and the first spacer having the rectangular plate shape extends from an end closer to the other of the first side surfaces to the gap portion closer to the one of the first side surfaces on the bonded surfaces of the cores.

8. The heat exchanger according to claim 1, further comprising a header portion arranged on side surfaces different from the bonded surfaces of the cores and provided to straddle the spacer portion and to cover the flow path portions of the multiple cores, wherein the gap portion is arranged at a position that is different from a region in which the header portion is arranged and that is closer to the header portion in regions in which the temperature gradient on the bonded surfaces of the cores is relatively shallow.

* * * * *